United States Patent [19]

Poe et al.

[11] Patent Number: 4,530,529

[45] Date of Patent: Jul. 23, 1985

[54] EXTERNALLY ACCESSIBLE ADJUSTER FOR FLUSH LATCHES

[75] Inventors: Lloyd R. Poe, Long Beach; Bernard W. Henrichs, Villa Park, both of Calif.

[73] Assignee: Hartwell Corporation, Placentia, Calif.

[21] Appl. No.: 375,817

[22] Filed: May 7, 1982

Related U.S. Application Data

[63] Continuation of Ser. No. 153,420, May 27, 1980, abandoned.

[51] Int. Cl.[3] ..... E05C 5/00

[52] U.S. Cl. ..... 292/113; 292/341.18; 292/DIG. 31

[58] Field of Search ..... 292/113, 341.18, 158, 292/139, 341.19, 340, DIG. 31; 411/143

[56] References Cited

U.S. PATENT DOCUMENTS

| | | | |
|---|---|---|---|
| 491,908 | 2/1893 | Starz | 411/143 |
| 957,504 | 5/1910 | Frenot | 411/143 |
| 3,664,696 | 5/1972 | Poe | 292/66 |
| 4,183,564 | 1/1980 | Poe | 292/113 |

FOREIGN PATENT DOCUMENTS

| | | | |
|---|---|---|---|
| 981093 | 5/1951 | France | 292/DIG. 31 |

*Primary Examiner*—J. Franklin Foss
*Attorney, Agent, or Firm*—Lyon & Lyon

[57] ABSTRACT

An externally accessible adjuster and latch having a biasing means such as a leaf spring for preventing inadvertent rotation of the adjuster.

2 Claims, 4 Drawing Figures

EXTERNALLY ACCESSIBLE ADJUSTER FOR FLUSH LATCHES

This is a continuation of application Ser. No. 153,420, filed May 27, 1980, now abandoned.

BACKGROUND OF THE INVENTION

Flush type latch assemblies are used extensively on aircraft for receiving flush mounted hinged or removable panels. Such panels are subject to substantial stress and care must be taken that each latch assembly is properly adjusted to take an appropriate portion of the load. Usually adjustment has required unfastening the latch assembly, making an adjustment, then relatching the assembly, a time consuming and not always dependable procedure. Special latch assemblies have been developed wherein the latch arm is externally accessible for adjustment.

SUMMARY

The present invention is directed to the combination of an externally accessible adjuster and latch as defined in previously issued U.S. Pat. No. 4,183,564 issued Jan. 15, 1980 with a biasing means detent such as a leaf spring for preventing inadvertent rotation of the adjuster by vibration etc.

DETAILED DESCRIPTION

The externally accessible adjuster for flush latches is particularly adapted for use on aircraft represented fragmentarily by surface structure 11 in which is set a panel 12 supported in a surrounding frame 13.

The externally accessible adjuster may be adapted for use with a variety of latch assemblies. The latch assembly herein illustrated is essentially that shown in U.S. Pat. No. 2,712,955. However, a wide variety of flush type hook latches may be used; for example, but not limited to, the flush type latches shown in U.S. Pat. Nos. 2,894,777; 2,904,141; 3,318,624; 3,503,642; 3,515,422; and 3,542,410.

Figure 1:
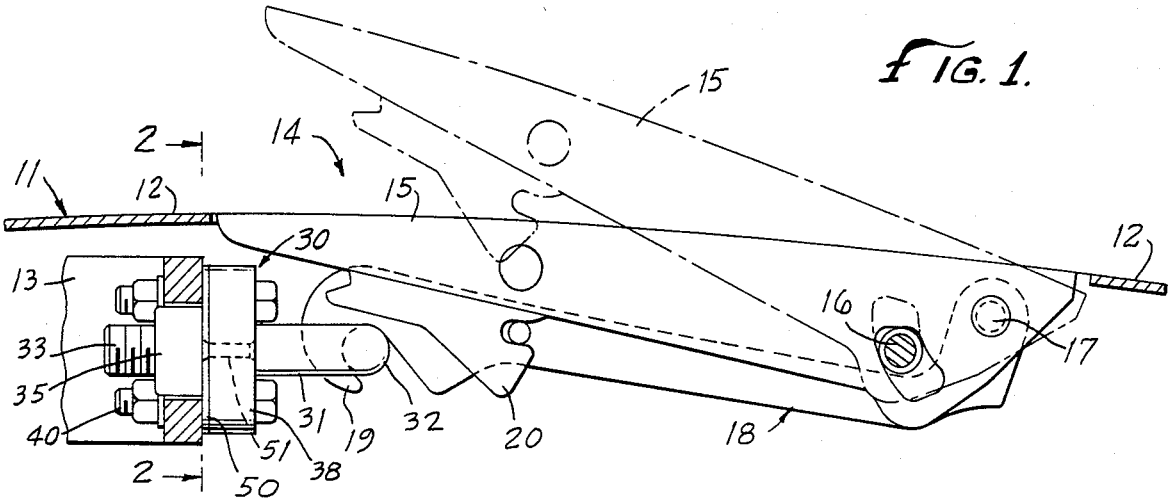
FIG. 1 is a side view of a flush type latch set in a surrounding surface.

The selected latch assembly designated 14 includes a handle 15 adapted to occupy a flush position in the panel 12. The handle is pivoted about a journal pin 16 so that it may be moved between a flushed closed position and an angular position for manual engagement. Connected to the handle 15 by a journal pin 17 is a latch arm 18 having a hook end 19. When in the flush position, the handle 15 and latch arm 18 are joined together by a flush type linking latch 20 carried by the handle 15 and adapted to secure the handle and latch arm 18 when the latch assembly is in its closed position shown in FIG. 1. The linking latch 20 is manually engagable for releasing the handle 15.

The adjuster includes an adjuster assembly 30 having a U-shaped keeper 31 provided with a cross pin 32 and a screwthreaded shaft 33. In order to prevent rotation of the shaft 33, the shaft 33 is provided with axial slot 27 which receives a ridge 28.

The shaft 33 receives a tension adjustment wheel 34 having an internally screwthreaded sleeve 35 having a flanged end 36 provided with radial slots 37. A base plate 38 is received on the shaft 33 adjacent to the keeper 12. The base plate 38 includes laterally spaced raised portions 39 between which is positioned the flanged end 36 of the tension adjustment wheel 34.

The raised portions 39 engage the frame member 13 so that the flanged end 36 is freely rotatable but is axially restrained with respect to the base plate 38. Screws 40 secure the base plate to the frame member 13. The flanged end 36 is positioned in a plane disposed adjacent an end of the panel opening 41 which receives the handle 15. To prevent rotation of the shaft 33 and keeper 31, the base plate 38 is provided with an aperature 42. A pair of biasing means such as leaf springs 50 are attached to raised portions 39 of base plate 38 by means of a conventional rivet or the like 51. Leaf spring 50 includes a detent 52 which engages radial slot 37 of tension adjustment wheel 34.

Figure 2:
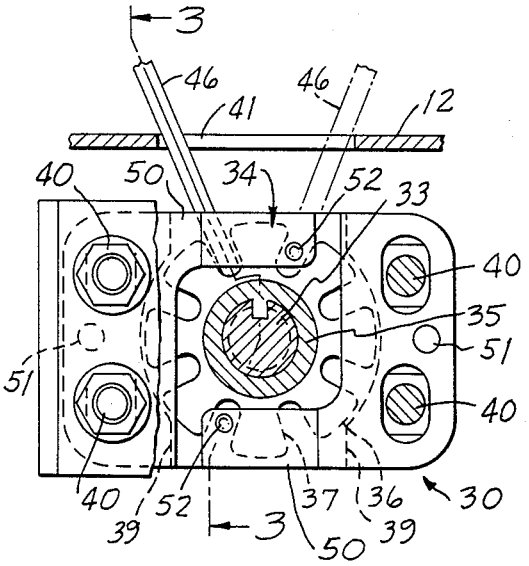
FIG. 2 is an enlarged sectional view taken through 2—2 of FIG. 1.
Figure 4:
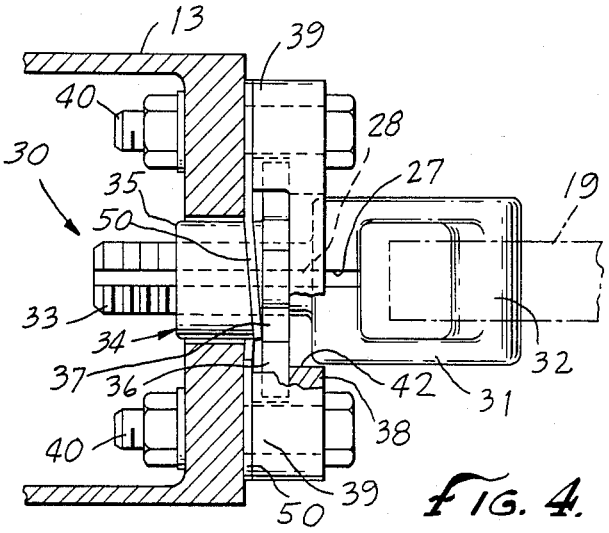
FIG. 4 is a view taken from 4—4 of FIG. 3.
Figure 3:
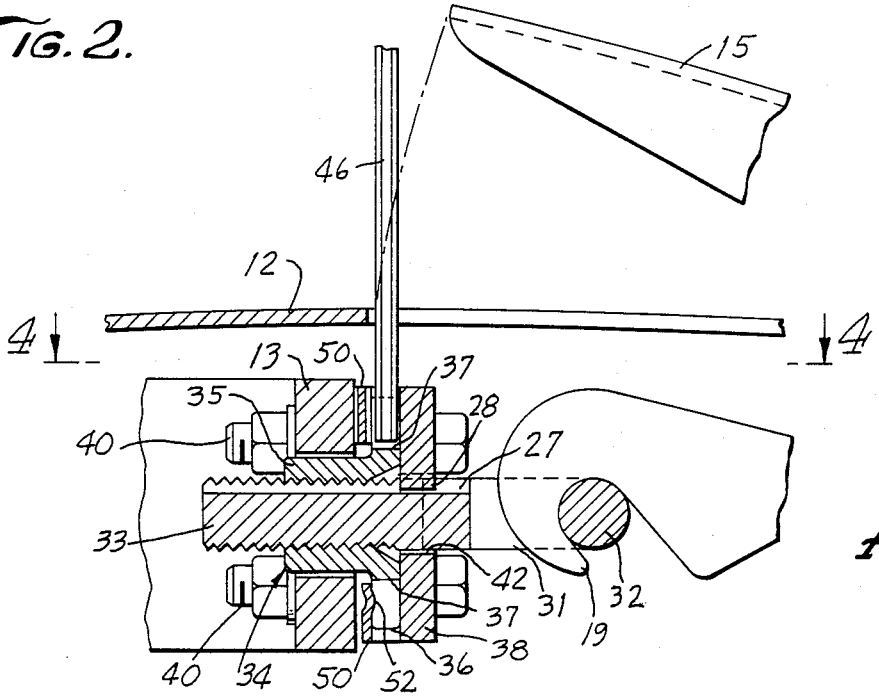
FIG. 3 is an enlarged sectional view taken through 3—3 of FIG. 2.

Operation of the embodiment of the adjuster for flush latches shown in FIGS. 1–4 is as follows:

The standard type of flush latch is so arranged that the handle 15 is capable of limited rotational movement without altering the connection between the latch arm 18 and the keeper cross pin 32. This is accomplished by releasing the linking latch 10. As shown in FIG. 3, this initial angular movement of the handle 15 pivots it so as to provide access to the adjustment wheel 34. The flanged end 36 of the adjustment wheel 34 is so positioned as to be readily accessible so that a turning tool may be inserted adjacent the end of the opening 41. The turning tool may be a conventional Allen wrench 46. Arcuate motion of the turning tool may be accomplished as indicated in FIG. 2. Such movement advances or retracts the shaft 33. In use, the tension adjustment wheel 34 is not subject to rotational force; therefore, the detent 52 secures the adjustment which is made in increments of the spacing between the radial slots 37.

Having fully described our invention, it is to be understood that we are not to be limited to the details herein set forth, but that our invention is of the full scope of the appended claims.

We claim:

1. A latch mechanism for joining first and second members, comprising a latch arm mounted to the first member;

a keeper element for engaging said latch arm;

a screw threaded shaft extending from said keeper element;

a guide on the second member slidably receiving said shaft;

a wheel screw threaded on said shaft, rotatably mounted in said guide and having a ring of radially extending slots accessible in sequence through an access opening in the first member to a turning tool; and at least one leaf spring fixed relative to the guide and having a detent biased by said leaf spring toward engagement with said slots of said wheel.

2. The latch mechanism of claim 1 wherein said guide includes a plate fixed relative to the second member to axially retain said wheel.

* * * * *